US009635963B2

(12) United States Patent
Blazar

(10) Patent No.: US 9,635,963 B2
(45) Date of Patent: May 2, 2017

(54) WASHABLE FOAM PILLOW

(71) Applicant: Jiajing USA, Inc., Richmond (CA)

(72) Inventor: Joseph E. Blazar, Owensboro, KY (US)

(73) Assignee: Jiajing USA, Inc., Richmond (CA)

( * ) Notice: Subject to any disclaimer, the term of this patent is extended or adjusted under 35 U.S.C. 154(b) by 0 days.

(21) Appl. No.: 13/908,553

(22) Filed: Jun. 3, 2013

(65) Prior Publication Data

US 2014/0082846 A1 Mar. 27, 2014

Related U.S. Application Data

(63) Continuation-in-part of application No. 13/624,525, filed on Sep. 21, 2012.

(60) Provisional application No. 61/537,986, filed on Sep. 22, 2011.

(51) Int. Cl.
*A47G 9/10* (2006.01)
*D05B 11/00* (2006.01)

(52) U.S. Cl.
CPC ..... *A47G 9/10* (2013.01); *D05B 11/00* (2013.01); *Y10T 29/49826* (2015.01); *Y10T 156/10* (2015.01)

(58) Field of Classification Search
CPC ..... A47G 9/10
USPC ..... 5/630, 636, 645, 641
See application file for complete search history.

(56) References Cited

U.S. PATENT DOCUMENTS

| | | | | |
|---|---|---|---|---|
| 2,975,437 | A | 3/1961 | Freeman | |
| 3,148,389 | A * | 9/1964 | Lustig | 5/645 |
| 4,042,986 | A | 8/1977 | Goodman et al. | |
| 4,184,237 | A * | 1/1980 | Blankenship | B68G 1/00 29/451 |
| 4,384,381 | A | 5/1983 | Lowthian | |
| 4,508,044 | A * | 4/1985 | Downey et al. | 112/475.08 |
| 4,536,906 | A | 8/1985 | Varndell et al. | |
| 5,210,891 | A | 5/1993 | Avital et al. | |
| 5,475,881 | A | 12/1995 | Higgins et al. | |
| 5,588,168 | A | 12/1996 | Byrne et al. | |
| 5,638,564 | A | 6/1997 | Greenawalt et al. | |
| 6,026,527 | A | 2/2000 | Pearce | |
| 6,223,371 | B1 | 5/2001 | Antinori et al. | |
| 6,745,419 | B1 | 6/2004 | Delfs et al. | |
| 6,823,546 | B1 | 11/2004 | Hsu | |
| 6,931,682 | B2 * | 8/2005 | Kruger, Jr. | 5/645 |
| 7,051,389 | B2 | 5/2006 | Wassilefky | |
| 2001/0018777 | A1 | 9/2001 | Walpin | |
| 2004/0139552 | A1 | 7/2004 | Walters | |
| 2004/0255385 | A1 | 12/2004 | England | |

(Continued)

OTHER PUBLICATIONS

U.S. Appl. No. 14/600,989, Office Action, mailed Aug. 31, 2016, 11 pages.

*Primary Examiner* — Fredrick Conley
(74) *Attorney, Agent, or Firm* — Conley Rose, P.C.; Kristin Jordan Harkins

(57) ABSTRACT

Embodiments relate generally to washable pillows, particularly washable foam pillows, and methods for assembling such pillows. The washable pillow may comprise one or more cushion element and a fabric cover attached to and possibly enclosing the one or more cushion element. The pillow may also comprise a shell formed by the one or more cushion element, wherein the shell may comprise a cavity therein, and the cavity may contain a filler material.

18 Claims, 6 Drawing Sheets

(56) References Cited

U.S. PATENT DOCUMENTS

| | | | | |
|---|---|---|---|---|
| 2005/0060807 | A1* | 3/2005 | Kaizuka | A47G 9/007 5/636 |
| 2005/0204471 | A1 | 9/2005 | Ruiz | |
| 2005/0278852 | A1* | 12/2005 | Wahrmund | A47C 27/05 5/636 |
| 2006/0010608 | A1 | 1/2006 | DeFranks et al. | |
| 2007/0113347 | A1* | 5/2007 | Lindell | A47G 9/10 5/636 |
| 2009/0142551 | A1 | 6/2009 | Fox et al. | |

* cited by examiner

WASHABLE FOAM PILLOW

CROSS-REFERENCE TO RELATED APPLICATIONS

This application is a Continuation-In-Part related under 35 USC §120 to U.S. patent application Ser. No. 13/624,525, filed Sep. 21, 2012 and entitled "Washable Mattress Topper", which claims benefit under 35 USC §119 from U.S. Provisional Patent Application Ser. No. 61/537,986 filed Sep. 22, 2011, entitled "Washable Mattress Topper," all of which are hereby incorporated by reference for all purposes.

STATEMENT REGARDING FEDERALLY SPONSORED RESEARCH OR DEVELOPMENT

Not applicable.

REFERENCE TO A MICROFICHE APPENDIX

Not applicable.

FIELD

Embodiments may relate generally to pillows, especially pillows comprising an open cell foam material which may be machine or hand washable.

BACKGROUND

Pillows may be used in many different applications, including sleeping or lying down, for head support and/or body support, for example, and sitting, for back support and/or neck support, for example, among others. Pillows may be designed to provide support for a portion of a person's body, typically the head and/or neck, and the shape, size, and/or support characteristics, such as firmness and/or thickness, for example, of the pillow may be chosen based on the desired application. In some instances, a pillow may become soiled during use, and although a case or covering, for example, a fabric pillow case, may provide some protection to the pillow, it may be desirable that a pillow be machine or hand washable for hygienic reasons, including for removal of dirt, allergens and other irritants.

SUMMARY

Aspects of the disclosure may include embodiments of a washable pillow comprising one or more of the following: one or more cushion element comprising open cell foam; a shell formed by the one or more cushion element, wherein the shell defines a cavity; a filler material contained within the cavity; and a fabric cover attached to at least one surface of the one or more cushion element. In an embodiment, the fabric cover may be attached to the one or more cushion element by at least one of stitching, gluing, and/or laminating. In an embodiment, the one or more cushion element may comprise two cushion elements attached in proximity to their edges to form the shell and to define cavity. In an embodiment, the fabric cover may be attached to an outer surface of the shell formed by the two cushion elements, wherein the fabric cover may comprise an upper surface and a lower surface. In an embodiment, the two cushion elements may be attached in proximity to their edges by stitching, wherein the stitching may comprise threading through the upper surface of the fabric cover, the two cushion elements, and the lower surface of the fabric cover.

In an embodiment, the one or more cushion element may comprise one cushion element folded to form two halves, wherein the two halves may be attached in proximity to their edges to form the shell and to define cavity. In an embodiment, the fabric cover may be attached to an outer surface of the shell formed by the one cushion element, wherein the fabric cover may comprise an upper surface and a lower surface. In an embodiment, the two halves of the cushion element may be attached in proximity to their edges by stitching, wherein the stitching may comprise threading through the upper surface of the fabric cover, the two halves of the cushion element and the lower surface of the fabric cover.

Additional aspects of the disclosure may include embodiments of a washable pillow comprising one or more of the following: a shell comprising open cell foam material, wherein the shell defines a cavity; a filler material contained within the cavity of the shell; and a fabric cover attached to the outer surface of the shell by at least one of stitching, gluing, and/or laminating. In an embodiment, the shell may be formed by two cushion elements attached in proximity to their edges, and the two cushion elements may be attached by stitching with thread, wherein the stitching may comprise threading through the fabric cover and both of the cushion elements. In an embodiment, the stitching may comprise serging the edges of the cushion elements and the fabric cover and channel stitching in proximity to the edges of the fabric cover and the cushion element. In an embodiment, the shell may comprise an uncompressed thickness of approximately ¼ inch. In an embodiment, the fabric cover may comprise natural material, synthetic material, or a combination thereof.

Other aspects of the disclosure may include embodiments of a process for assembling a washable pillow comprising one or more of the following: providing a cushion element comprising open cell foam; providing a fabric cover; attaching the fabric cover and the cushion element; forming a shell defining a cavity therein from the attached fabric cover and cushion element; filling the cavity with a filler material; and sealing the shell to contain the filler material. In an embodiment, forming a shell defining a cavity therein from the attached fabric cover and cushion element may comprise: cutting the attached cushion element and fabric cover into two elements of a desired shape and size; placing the two elements adjacent to one another to form the shell with the fabric cover on an outer surface of the shell; and attaching at least a portion of the two elements in proximity to their edges. In another embodiment, forming a shell defining a cavity therein from the attached fabric cover and cushion element may comprise: cutting the attached cushion element and fabric cover to a desired shape and size; folding the attached cushion element and fabric cover to form two halves; placing the two halves adjacent to one another to form the shell with the fabric cover on an outer surface of the shell; and attaching at least a portion of the two halves in proximity to their edges. In an embodiment, attaching the fabric cover to the cushion element may comprise: rolling glue onto at least one surface of the cushion element; placing the fabric cover against the at least one surface of the cushion element with the glue there between; and laminating the fabric cover to the cushion element by heating in a heat tunnel. In an embodiment, sealing the shell to contain the filler material may comprise stitching with thread applied through the fabric cover and the cushion element, wherein, in an embodiment, stitching with thread may comprise serging the edges of the attached fabric cover and cushion element, and channel stitching in proximity to the edges of the attached fabric cover and cushion element.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
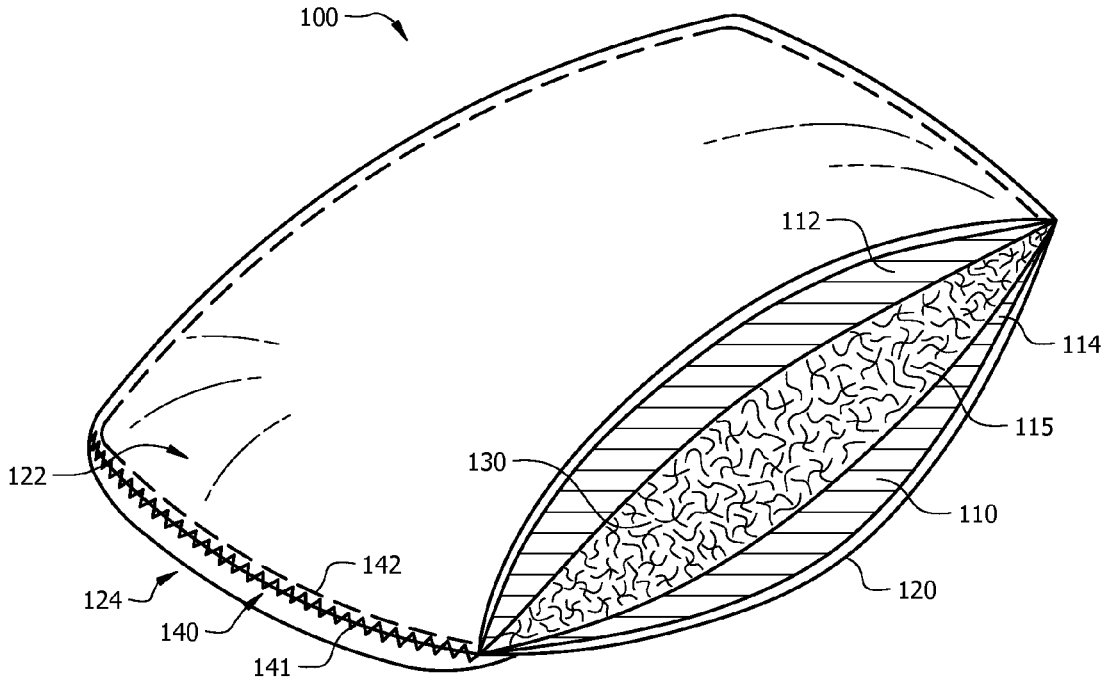
FIG. 1 illustrates an exemplary embodiment of a washable pillow.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments relate generally to pillows (or other cushioned support devices) which may be made washable by attachment of one or more cushion elements within the pillow (which may comprise an open cell material) to a cover (which may for example comprise a breathable fabric material). While the embodiments described below may discuss pillows, it should be understood that embodiments may also relate to other cushioned support devices (such as mattress toppers, mattresses, or elements within a mattress, for example) which may comprise an open cell material. Furthermore, while the washable pillow examples herein may generally be discussed in the sleeping context or for use for support of the head and/or neck of a user, washable cushioned support devices (with similar features) may have other uses (for example, seating cushions or lumbar support cushions), all of which are within the scope of this disclosure. Additional information regarding cushioned support devices may be found in U.S. patent application Ser. No. 13/624,525, the contents of which are incorporated by reference herein as if reproduced in its entirety, to the extent that it is consistent with the present disclosure.

Pillows generally are designed for the purpose of increased comfort while sleeping and to support the head and/or neck of a user (or in other embodiments another portion of the user's body while in a lying position). It is typically not common practice to wash and/or dry an entire pillow (particularly a foam pillow) because it may cause deterioration of the cushioning element(s) of the pillow. In an embodiment, open cell (or reticulated) foam may be used as a cushion element for pillows (or other cushioned support devices), wherein open cell foam may be desirable based on its ability to conform to the shape of at least a portion of the body. Due to the nature of open cell foam, it may not be durable when washed and/or dried by itself, wherein the foam material tends to deteriorate or break-down if washed and/or dried. It may be desirable that a pillow be machine or hand washable for hygienic reasons, including the elimination of dirt, allergens and other irritants (e.g. dust mites, bed bugs, mold and dead skin). The present disclosure teaches the attachment of a fabric cover to the one or more cushion elements of a pillow in a manner that provides stability for the cushion element(s), wherein the fabric cover is permanently attached to and/or encloses the cushion element(s). In this disclosure, "permanently attach and/or enclose" means that it may be possible to remove the fabric cover by laboriously cutting or otherwise removing the attachment between the cover and the cushion element(s) (wherein the attachment may comprise stitches and/or an adhesive, for example), but this removal may effectively destroy or ruin the pillow. At the least, it would be very inconvenient to remove the fabric cover, and removal would defeat at least one of the benefits of the pillow. In the language of this disclosure, "permanently" means that the fabric cover encloses the cushion element for the duration of the functional life of the disclosed pillows.

Not wishing to be bound by theory, it is thought that the attachment of the one or more cushion elements to a fabric cover on at least one surface of the cushion element (by stitching, gluing, and/or lamination, for example) may afford a stability which would allow the pillow to be machine or hand washed on a regular basis without deterioration of the cushion element(s), thereby extending the life of the pillow and its overall value to a consumer. In some embodiments, the attachment of the one or more cushion elements to the fabric cover may be accomplished by stitching though both the fabric cover and cushion element(s) (wherein in some embodiments, the stitching may form a plurality of compartments within the cushion element(s)), while in other embodiments, the attachment of the one or more cushion elements to the fabric cover may be accomplished by gluing and/or laminating the fabric cover to at least one surface of the cushion element, and in still other embodiments, a combination of the techniques of stitching and gluing/laminating may be used.

In one embodiment the cushion element(s) of the pillow may comprise open cell (or reticulated) foam, which may comprise materials such as polyurethane, latex, gel or another such material that would provide cushioning properties. In an embodiment, the open cell foam material may comprise a particular cell size, cell wall strength, elasticity, as well as other cell properties, wherein the cell properties may be variable (and/or governable) based on methods of manufacturing the foam. Someone skilled in the art would be able to select a foam material (or a method of manufacturing a foam material) with certain properties to achieve a desired design of a cushioned support device, wherein the design variables may include comfort, support, weight, ability to absorb water, and/or ability to eliminate water. For example, the cell properties of a foam material may affect the ability and/or rapidity of a foam to dry after becoming wet (such as in a washing/drying process, for example) as well as the support provided by the foam material. In some embodiments, a person skilled in the art may choose a foam material wherein the comfort or support properties may be compromised if a rapidly drying foam is desired, while in another embodiment, a foam material may be chosen wherein the rapidity of drying is compromised for increased comfort or support. In other words, different characteristics of foam materials may compete such that a balance may be considered based on the desired application of the foam material.

In one embodiment the cushion element(s) of the pillow may comprise open cell (or reticulated) foam material, which may comprise materials such as polyurethane, latex, gel or another such material that would provide cushioning properties. In an embodiment, the open cell foam material may comprise a particular cell size, cell wall strength, elasticity, as well as other cell properties, wherein the cell properties may be variable (and/or governable) based on methods of manufacturing the foam. Someone skilled in the art would be able to select a foam material (or a method of manufacturing a foam material) with certain properties to achieve a desired design of a cushioned support device, wherein the design variables may include comfort, support, weight, ability to absorb water, and/or ability to eliminate water. For example, the cell properties of a foam material may affect the ability and/or rapidity of a foam to dry after becoming wet (such as in a washing/drying process, for example) as well as the support provided by the foam material. In some embodiments, a person skilled in the art may choose a foam material wherein the comfort or support properties may be compromised if a rapidly drying foam is desired, while in another embodiment, a foam material may be chosen wherein the rapidity of drying is compromised for increased comfort or support. In other words, different characteristics of foam materials may compete such that a balance may be considered based on the desired application of the foam material. The material of the cushion element(s) may also comprise air flow characteristics that may allow for an increased amount of air flow through the material, and therefore allow for washing and/or drying of the material. In an embodiment, the pillow may comprise any standard size/shape, such as standard, queen, and/or king, as well as nonstandard shapes or sizes, and may in some embodiments be designed to have a particular firmness and/or thickness.

In an embodiment shown in FIG. 1, a pillow 100 may comprise at least one cushion element 110 with a fabric cover 120 attached to and possibly enclosing the cushion element 110. In an embodiment, the at least one cushion element 110 may comprise a first cushion element 112 and a second cushion element 114, wherein the first and second cushion elements form a shell that wraps around a cavity 115. In some embodiments, the cavity 115 may be filled with a filler material 130 operable to afford additional comfort and/or support to a user of the pillow 100. The first cushion element 112 and second cushion element 114 may be held together in the form of the shell by an attachment 140 (which may comprise sealing the edges of the shell by stitching, for example). In an embodiment, the cushion element(s) 110 may comprise open cell (or reticulated) foam. The fabric cover 120 may comprise natural materials (such as cotton, linen, wool, silk, or bamboo, for example), synthetic materials (such as polyester, rayon, Dacron, nylon, acrylic, Lycra, or olefin fibre, for example), or a combination (or blend) thereof. Any combination and/or construction of natural materials and/or synthetic materials may be suitable for the fabric cover 120, and, in some embodiments, the cover 120 may be configured so as to resist significant shrinking and/or stretching of the fabric when washed and/or dried. This may be accomplished by preshrinking the fabric cover material, using a specific type of weave for the material, and/or using specific material(s) for the fabric cover that are known to be stable. Stability of the fabric cover may also be provided by gluing and/or laminating the fabric cover to at least one surface of the cushion element. Typically, the fabric cover 120 may comprise a woven material.

In an embodiment, the attachment 140 may attach the fabric cover 120 to at least one surface of the cushion element(s) 110 (wherein, in the embodiment of FIG. 1, the fabric cover 120 may be attached to the outer surfaces of both the first cushion element 112 and the second cushion element 114), and the attachment 140 may be operable to seal the shell formed by the cushion element(s) 110, for example to contain the filler material 130 within the cavity 115 of the shell. In an embodiment, the attachment 140 may comprise stitching continuous lines with thread through both the fabric cover 120 and at least a portion of the cushion element(s) 110. "Continuous" may refer to stitching without breaking/cutting the thread at any point in a particular line/distance. In an embodiment, the line/distance may comprise one edge of a pillow, multiple edges of a pillow, or a portion of an edge of a pillow. Although, in an embodiment, the thread may be visible on one side of the fabric cover 120 in a dashed fashion (such that the stitching alternates between two surfaces 122 and 124 of the fabric cover 120), it may be considered a continuous stitch if the thread used to make the stitch is not broken and/or cut along a specific line (such as at least a portion of an edge of a pillow). In an embodiment, a stitching pattern on a pillow 100 (such as may be formed by stitching 141 and 142) may be formed by one or more continuous lines of stitching and/or a serger method of stitching. The stitching 141 and 142 may be applied through the fabric cover 120, the first cushion element 112, and the second cushion element 114 (i.e. between top 122 and bottom 124 surfaces of the fabric cover 120) so that, in an embodiment, the distance between the top 122 and bottom 124 of the pillow 100 at the stitching 140 may be about ⅛ inch. Generally, the thickness of the at least one cushion element 110 (or the two cushion elements 112 and 114) at the attachment 140 may be a thickness at which the cushion element(s) 110 are compressed, wherein the cushion element(s) 110 may be approximately fully compressed or partially compressed. Additionally, the compression at the attachment 140 may be accomplished by applying a specific force to the cushion element(s) 110. In some embodiments, the attachment 140 may be located in proximity to the edge of the cushion element(s) 110 and/or the fabric cover 120, and typically, the attachment may be located between about ⅛ inch and about ¼ inch from the edge of the cushion element(s) 110 and/or the fabric cover 120.

In an embodiment, the attachment 140 may be completed using one or more stitching methods, which may include channel stitching 142 and/or serging 141. In an embodiment, the fabric cover 120 and one or more cushion elements 110 may first be serged at their edges (i.e. sewn with thread from one surface 122 of the fabric cover 120 to the other surface 124 (or vice versa) through the cushion element(s) 110). Then, channel stitching 142 may be used at a location inset from the edge of the cushion element(s) 110. In an embodiment, the channel stitching 142 may reinforce the edge of the cushion element 110 and fabric cover 120 attached by serging 141. In other words, the channel stitching 142 may serve to reinforce and/or provide stability for the serged stitching 141, and may be operable to prevent tearing, puckering, and/or other deformations at or around the attachment 140. The embodiment of attaching the fabric cover 120 and cushion element(s) 110 combining the use of serging and channel stitching may allow for increased stability of the cushion element 110 in the stitching pattern. In an embodiment, the serging followed by channel stitching may firmly fix the cushion element 110 at the edges, such that during washing and/or drying, the cushion element 110 and/or the fabric cover 120 may not develop puckers or deformities at or around the attachment 140.

In an embodiment, the stitching 141 and 142, operable to attach at least the edges of the one or more cushion elements 110 and fabric cover 120, may be in a pattern such that the number of stitches per inch may be between about 4 and about 8, and in some embodiments, may comprise between approximately 5 to 7 stitches per inch. In a typical embodiment, the stitching pattern 110 and 112 may comprise approximately 6 stitches per inch. In an embodiment, the thread used for the stitching may comprise Nylon and may have a thread weight of at least approximately Tex 6 (wherein Tex is the mass in grams of 1000 meters of thread). In other embodiments, the thread may comprise other materials such as cotton, polyester, a cotton-polyester blend, rayon, silk, or wool, which may be chosen based on the desired qualities of the thread such as strength, thickness, appearance, and/or cost.

In an embodiment, the cushion element(s) 110 may comprise an uncompressed thickness up to approximately 1 inch. An embodiment of the cushion element(s) 110 may have an uncompressed thickness of at least 0.1 inch and may typically be about 0.25 inches thick. Different factors that may be considered to determine an optimal thickness of a cushion element 110 for a pillow 100 may include user comfort, ability to be washed and/or dried, and/or ability to be sewn through with stitching to create compartments and/or attachment to the fabric cover 120. In some embodiments, where a serging method may be used to attach the edges of the cushion element 110 and fabric cover 120, the capabilities of the serger machine used may be considered when determining the thickness of the cushion element(s) 110. A desired thickness may also depend on the density of the cushion element(s) 110, wherein a typical embodiment of the cushion element 110 may comprise a density of about 3 lb. per board foot (wherein 1 lb. per board foot may be the equivalent of 12 lb. per cubic foot). In some embodiments, the cushion element(s) 110 may comprise a rectangular (or cuboid) shape, which in other embodiments, the cushion element(s) 110 may comprise an irregular shape wherein, for example, the edges of the cushion element 110 may be tapered or thinned.

In some embodiments, the amount and/or thickness of the filler material 130 within the pillow 100 may be varied based on a desired thickness and/or firmness of the pillow 100. For example, a particular weight of the filler material (or of the pillow containing the filler material) may correspond to a qualitative description of the pillow, such as plush, soft, medium, and/or firm. In some embodiments, the filler material 130 may comprise fibers and/or shreds of cushioning material, while in other embodiments, the filler material 130 may comprise a solid insert with a defined size/shape. In a typical embodiment, the filler material 130 may comprise a loose polyester fiber, wherein polyester fibers may be considered naturally washable (or water resistant). The denier (or thickness) of the fibers may additionally affect the firmness of the pillow 100, wherein the denier may be varied based on a desired firmness. In an embodiment, the filler material 130 may comprise approximately 15 denier polyester fibers, for example, but in other embodiments a lower or higher denier fiber may be used. In alternative embodiments, the filler material 130 could comprise any cushion material that may be considered washable, such as granulated or shredded foam, synthetic fiber material, as well as conventional materials (such as feathers, granulated cotton and/or cotton fibers).

In an embodiment, the fabric cover 120 may be glued and/or laminated to at least one surface of the one or more cushion elements 110. This may be accomplished by rolling a glue or other adhesive onto the surface of the cushion element 110, placing the fabric cover against the surface of the cushion element 110 (such that the glue is between the cushion element and the fabric cover), and then laminating the combination of the fabric cover and the cushion element. In an embodiment, laminating the fabric cover 120 to the cushion element(s) 110 may provide stability for the attachment 140. For example, the fabric cover may be less likely to move, misalign, pucker, or have deformities at the stitching if the fabric cover 120 is first laminated to the cushion element 110.

Figure 2:
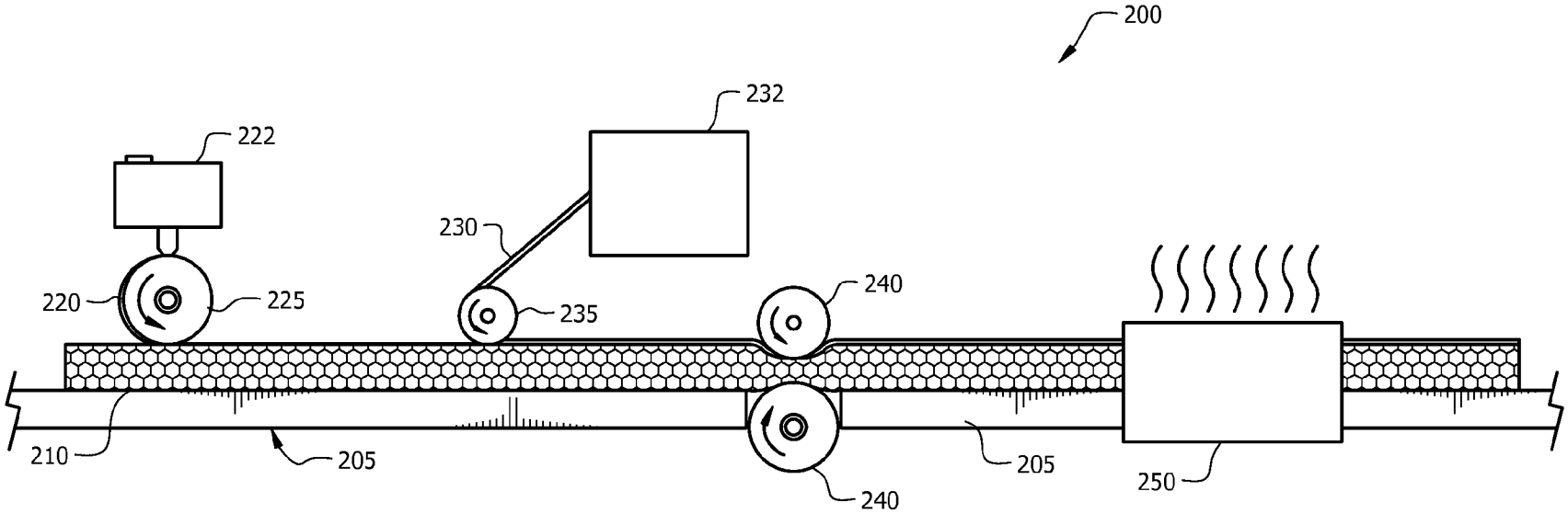
FIG. 2 illustrates a lamination system according to an embodiment of the disclosure.

As shown in the embodiment of FIG. 2, the cushion element may be cut to a desired thickness and then fed through a lamination system 200. A first roller 225 may apply an adhesive 220 to at least one surface of the cushion element 210 (wherein the adhesive 220 may be stored in an adhesive container 222). A second roller 235 may place the fabric cover 230 onto the at least one surface of the cushion element 210 (wherein the fabric cover 230 may be stored in a fabric container 232). The adhesive 220 may attach the fabric cover 230 to the cushion element 210, wherein the combined fabric cover and cushion element may then be fed through pressure rollers 240 operable to press the fabric cover to the cushion element, and in some embodiments the pressure rollers may strengthen or reinforce the attachment of the fabric cover 230 to the cushion element 210. Then, in an embodiment, the combined fabric cover, adhesive and cushion element may be fed through a heating tunnel 250, wherein the heat provided by the heating tunnel 250 may laminate the fabric cover 230 to the cushion element 210 by evaporating at least a portion of the adhesive 220. In an embodiment, the adhesive 220 may comprise an adhesive material (such as a glue, for example) in a water carrier, wherein when fed through the heat tunnel 250, the water carrier may evaporate, leaving the dried glue and forming a bond between the fabric cover 230 and cushion element 210. In some embodiments, the fabric cover may be attached to only one surface of the cushion element (as shown in FIG. 2), but in other embodiments, the fabric cover could be attached to two surfaces of the cushion element and/or the edges (or side surfaces) of the cushion element. After completing the process of the lamination system 200, a laminated fabric cover and cushion element may then be cut to a desired shape and/or size and assembled into an embodiment of a pillow, as discussed in this disclosure. In the embodiment of FIG. 2, the cushion element may be carried through the lamination system by a conveyor system 205, which may comprise any means for moving the foam through the system, such as conveyor belts, rollers, pulleys, as well as other means as known by those skilled in the art.

Figure 3A:
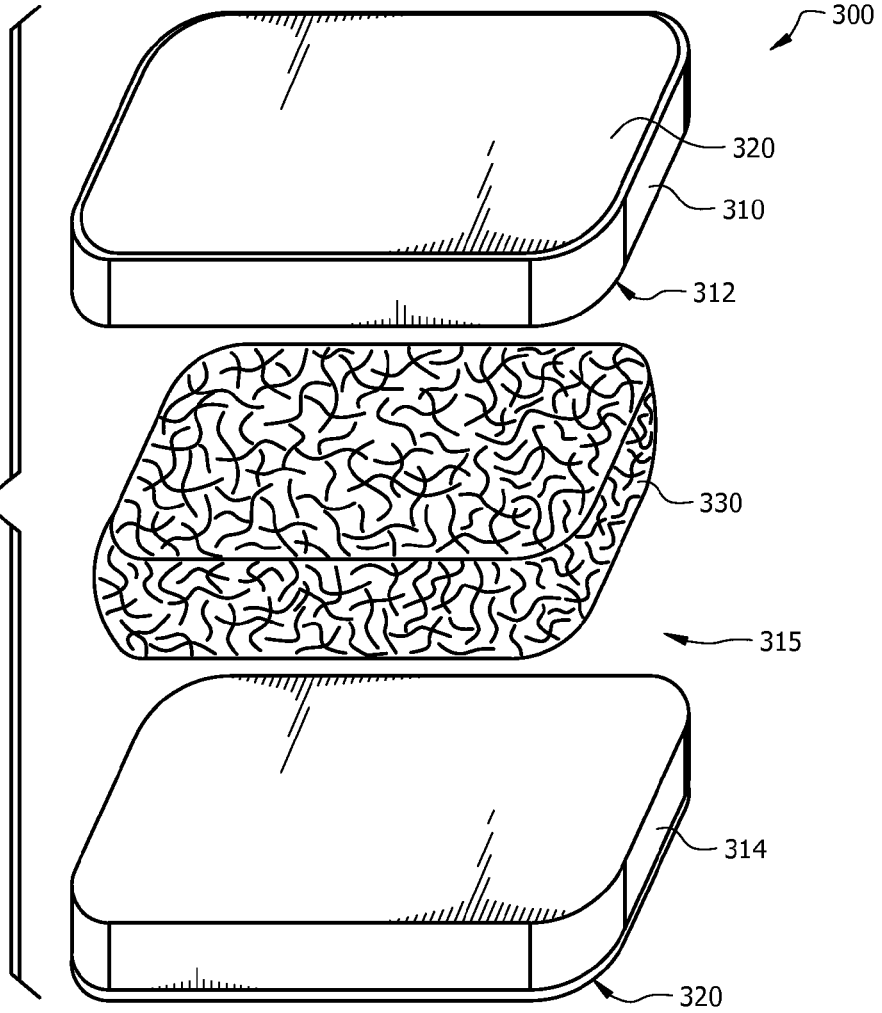
FIGS. 3A-3B illustrate exploded views of a washable pillow according to embodiments of the disclosure.
Figure 3B:
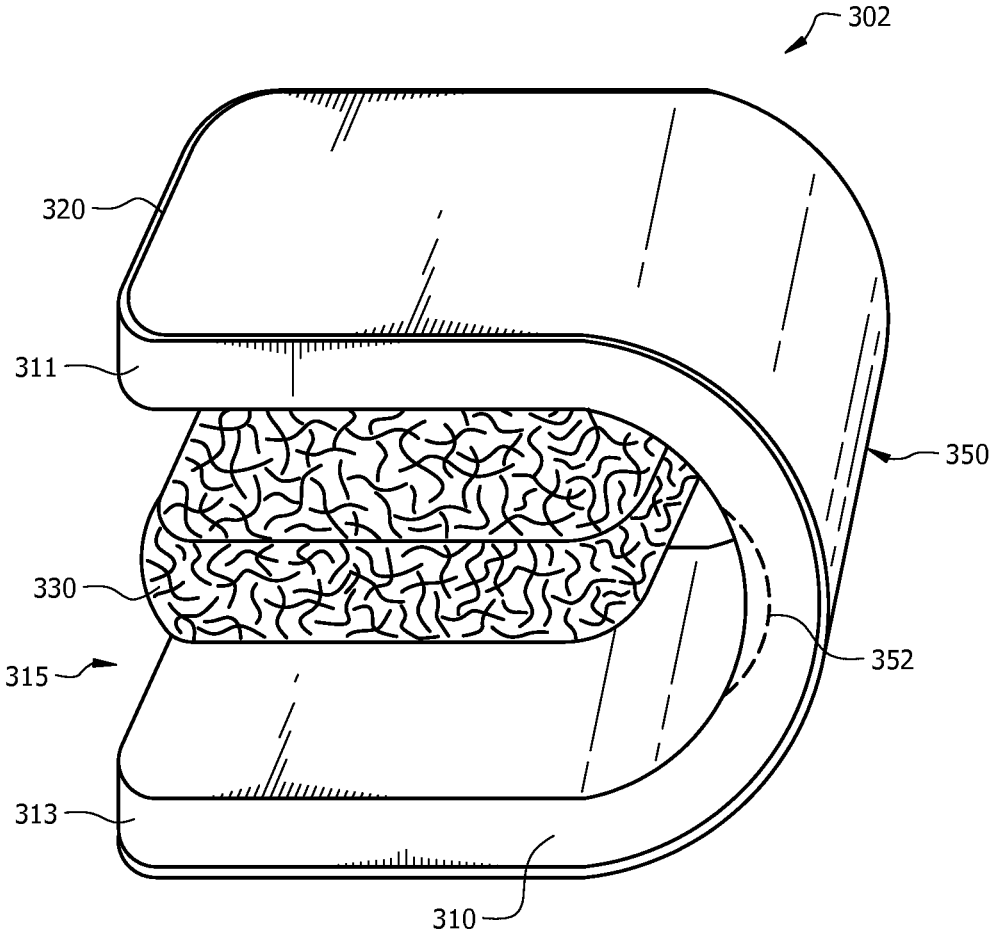

FIGS. 3A-3B illustrate exploded views of two embodiments of a pillow (i.e. views of uncompleted embodiments of a pillow), wherein FIG. 3A shows a pillow 300 comprising two cushion elements 312 and 314 forming a shell, and FIG. 3B shows a pillow 302 comprising one cushion element 310 which may be folded into two halves 311 and 313 forming a shell. In the embodiment of FIG. 3A, the pillow 300 may comprise a fabric cover 320 attached to at least one surface of the first cushion element 312 and at least one surface of the second cushion element 314 (wherein the fabric cover 320 may be attached by gluing, laminating and/or stitching, for example) for example in a process such as that described above with reference to FIG. 2. In an embodiment, the fabric cover 320 may be positioned on the outer surfaces of the cushion elements 312 and 314 when they form the shell of the pillow 300. In an embodiment, a filler material 330 may be located in a cavity 315 formed between the two cushion elements 312 and 314. In an alternative embodiment, shown in FIG. 3B, the pillow 302 may comprise one cushion element 310 that may be folded to form to halves 311 and 313 (wherein a fold 350 may comprise one edge of the pillow 302). The pillow 302 may comprise a fabric cover 320 attached to at least one surface of the cushion element 310 (wherein the fabric cover 320 may be attached by gluing, laminating, and/or stitching, for example), and in at embodiment, the fabric cover 320 may be positioned on the outer surface of the cushion element 310 when the folded halves 311 and 313 form the shell of the pillow 302. In an embodiment, a filler material 330 may be located in a cavity 315 formed between the two halves of the cushion element 310. In an embodiment, the cushion element 310 may be at least partially compressed at the fold 350, and in some embodiments, a portion of the cushion element 310 may be removed (such as by cutting at line 352, for example) proximate to the fold 350 (on the interior of the shell), which may facilitate folding and/or forming of the two halves 311 and 313.

Figure 3C:
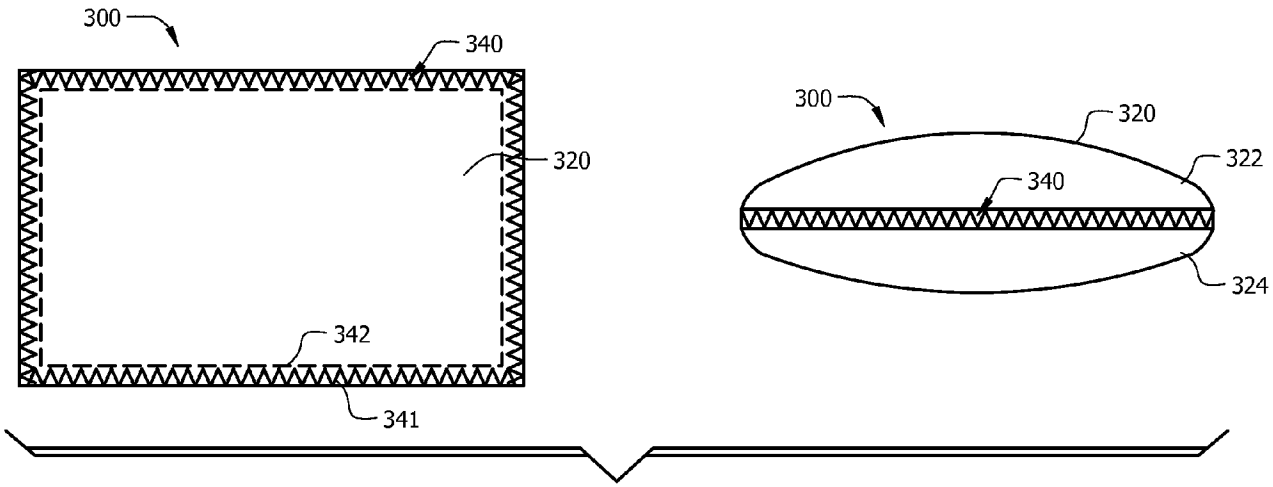
FIGS. 3C-3D illustrate views of a washable pillow according to embodiments of the disclosure.
Figure 3D:
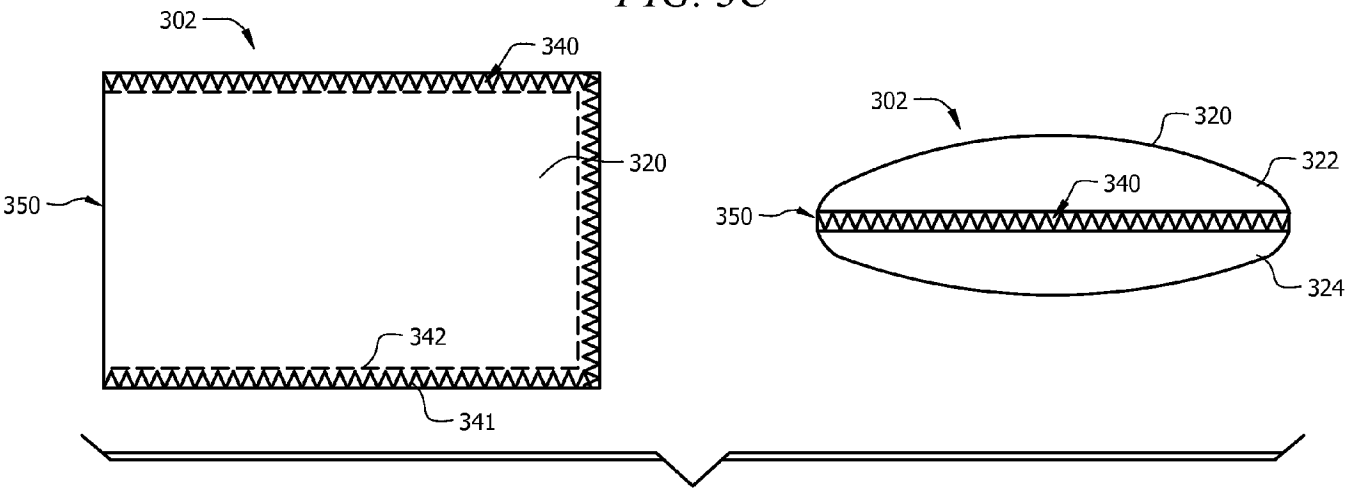

FIGS. 3C-3D show alternative views of the two embodiments described above in FIGS. 3A-3B, wherein FIG. 3C corresponds to FIG. 3A, and FIG. 3D corresponds to FIG. 3B. In FIGS. 3C-3D, the pillows are shown in a completed state, wherein the edges of the pillow elements (for example the cushion element(s) and the fabric cover) have been attached (for example by stitching) to form the shell which may for example be filled with filler material. FIG. 3A shows an embodiment wherein the pillow 300 may comprise two cushion elements, wherein the cushion elements may be attached on at least one surface to a fabric cover 320, and the edges of the cushion elements (and fabric cover 320) may be attached with stitching 340 to form the shell. In the embodiment of FIG. 3C, all four edges of the cushion elements (and fabric cover 320) may be attached with stitching 340, and the stitching may thread through both cushion elements as well as the two surfaces 322 and 324 of the fabric cover 320 (in other words, the stitching may connect the two surfaces 322 and 324 of the fabric cover 320 by threading through both cushion elements). In another embodiment, shown in FIG. 3D, the pillow 302 may comprise one cushion element which may be folded to form two halves, wherein the cushion element may be attached on at least one surface to a fabric cover 320. The two halves of the cushion element (and fabric cover 320) may be attached at their edges with stitching 340 to form the shell, wherein a fold 350 may comprise one edge of the pillow 302, and the other three edges of the cushion element (and fabric cover 320) may be attached with stitching 340. However, in some embodiments, the edge created by the fold 350 may also comprise stitching 340 (similar to the embodiment of FIG. 3C), for example, to provide reinforcement of the edge and/or to create a particular shape of the pillow. In both of the embodiments of FIGS. 3C-3D, the pillows may comprise a filler material located within the shell formed by the one or more cushion elements. Additionally, in some embodiments, the stitching 340 may comprise a serged stitch 341 at the edge of the cushion elements and the fabric cover 320. In an embodiment, the stitching 340 may also comprise a channel (or single needle) stitch 342 which may be inset from the edge of the cushion elements such that the channel stitching 342 does not cover or otherwise go around the edge of the cushion elements and/or the fabric cover.

Figure 4A:
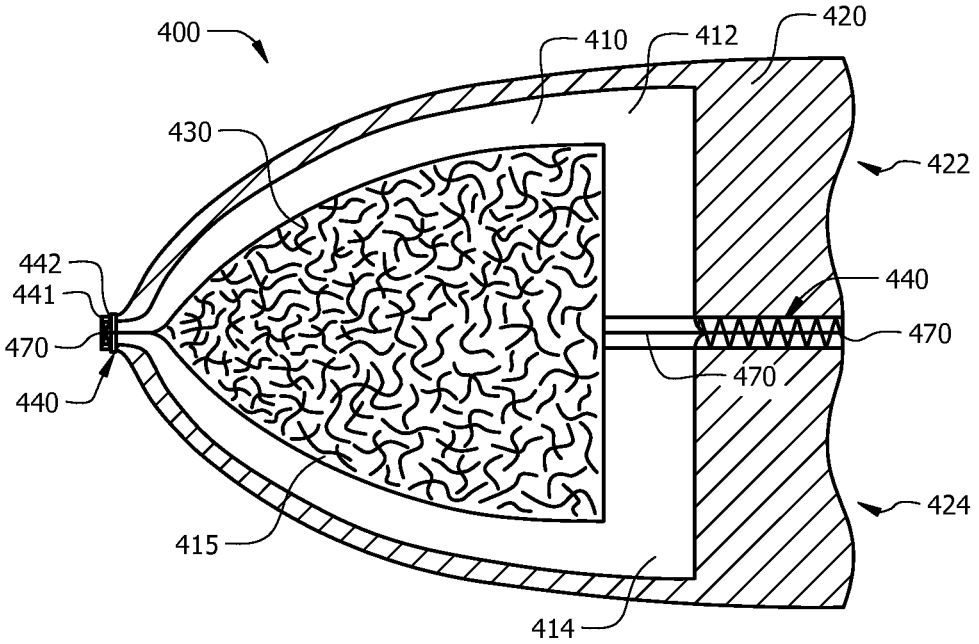
FIGS. 4A-4B illustrate partially cut-away cross-sectional views of embodiments of a washable pillow.
Figure 4B:
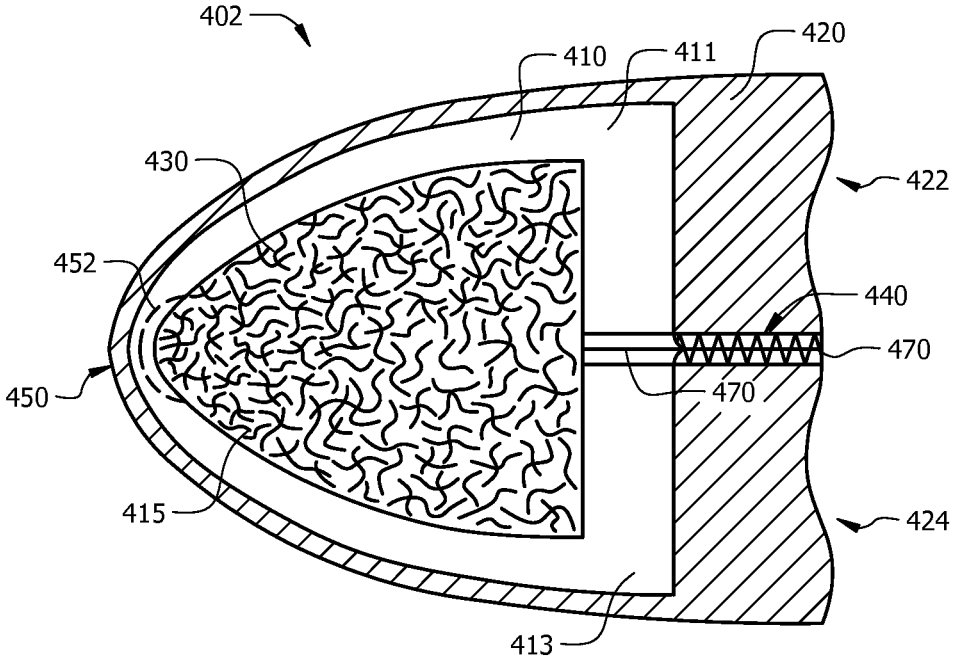

FIGS. 4A-4C illustrate partially cut-away cross-sectional views of embodiments of a washable pillow as discussed above. In FIG. 4A, the pillow 400 may comprise the at least one cushion element 410, a fabric cover 420, and filler material 430, wherein the at least one cushion element 410 may comprise a first cushion element 412 and a second cushion element 414, and the fabric cover 420 may comprise two surfaces 422 and 424. In the embodiment shown in FIG. 4A, the first cushion element 412 may be attached to the surface 422 of the fabric cover 420 by gluing, lamination, and/or stitching, and the second cushion element 414 may be attached to the surface 424 of the fabric cover 420 by gluing, lamination, and/or stitching. The two cushion elements 412 and 414 may also be attached to one another at their edges 470 by stitching 440, wherein the stitching may be located on at least three edges of the pillow 400, and in some embodiments the stitching 440 may be located at all four edges of the pillow 400. In the embodiment of FIG. 4A, the stitching 440 may comprise a serged stitch 441 at the edge of the cushion elements 412 and 414 and the fabric cover 420. In an embodiment, the stitching 440 may also comprise a channel (or single needle) stitch 442 which may be inset from the edge 470 of the cushion elements 412 and 414 such that the channel stitching 442 does not cover or otherwise go around the edge 470 of the cushion elements and/or the fabric cover. In some embodiments, the channel stitching 442 may be inset from the edge of the cushion elements by about ⅛ inch. In an embodiment, the channel stitching 442 may serve to reinforce and/or provide stability for the serged stitching 441, and may be operable to prevent tearing, puckering, and/or other deformations at or around the stitching 440. In some embodiments, only one method of stitching may be used at the edges of the pillow, a different method of stitching with thread than discussed above may be used, and/or another form of attachment may be used, such as stitching without continuous lines, fusing, use of adhesive, use of rivets, use of buttons, use of a zipper, or some combination thereof.

FIG. 4B illustrates a cross-sectional view of an embodiment (similar to embodiments shown in FIGS. 2B and 3B) of a pillow 402 comprising one cushion element 410 attached to a fabric cover 420 which may be folded to form two halves 411 and 413 (and two surfaces 422 and 424 of the fabric cover 420) with a cavity 415 formed between the two cushion element halves, wherein the cavity 415 may be filled with a filler material 430. In an embodiment, the pillow 402 may comprise stitching 440 (similar to the stitching 440 shown and described above in FIG. 4A) on at least three edges 470, wherein the forth edge of the pillow 402 may be formed by a fold 450 of the cushion element 410 and the fabric cover 420. In an embodiment, the fold 450 of the cushion element 410 may also be stitched (as described above in FIG. 4A). As described above in FIG. 3B, the cushion element 410 may be at least partially compressed at the fold 450, and in some embodiments, a portion of the cushion element 410 may be removed (such as by cutting at line 452, for example) proximate to the fold 450 (on the interior of the shell), which may facilitate folding and/or forming of the two halves 411 and 413.

An embodiment of the disclosure may comprise a method of assembling a washable pillow comprising attaching a fabric cover to at least one surface of a cushion element. The cushion element may then be divided into two cushion elements (for example by cutting) wherein the two cushion elements may be similar in shape and size. A step may comprise positioning the two cushion elements, to form a shell with a cavity therein, in such a way that the fabric cover may be located on the outer surface(s) of the shell formed by the two cushion elements and the fabric cover may comprise upper and lower surfaces. In an embodiment, a step may then comprise attaching at least a portion of the edges of the two cushion elements (wherein an embodiment comprises attaching at least three edges of the cushion elements, and optionally a portion of a forth edge). The attaching may comprise stitching with thread through both the upper and lower surfaces of the fabric cover as well as both cushion elements. In an embodiment, the attaching may comprise serging at least a portion of the edges of the two cushion elements and then channel stitching (or single needle stitching) behind the serged portion of the edge.

In an embodiment, at least a portion of one edge may be left open (not stitched together) so that a step of filling the cavity with filler material may be performed. In some embodiments, an entire edge may be left open, while in other embodiments a small portion of an edge may be left open. In some embodiments, a portion of the edge large enough to accommodate a nozzle and/or hose may be left open. In some embodiments, the filler material may be blown into the cavity of the pillow, for example though a nozzle and/or hose. Once a desired amount of filler material has been placed within the cavity, the method may comprise attaching the remainder of the edge(s) of the cushion elements in a similar fashion to the first step of attaching. In some embodiments, the pillow may then be considered completed, or, in other embodiments, the method may continue with further steps of covering the pillow or otherwise preparing the pillow for use by a consumer, for example.

Another embodiment of the disclosure may include steps for an alternative method of assembling a washable pillow comprising first attaching a fabric cover to at least one surface of a cushion element. The attached cushion element and fabric cover may then be folded into two halves forming a fold, wherein the two halves may be similar in shape and size. A step may comprise positioning the two halves, to form a shell with a cavity therein, in such way that the fabric cover may be located on the outer surfaces of the shell now formed by the two halves, and the fabric cover may comprise upper and lower surfaces. In an embodiment, a step may then comprise attaching at least a portion of the edges of the two halves (wherein an embodiment comprises attaching at least two edges of the cushion elements, and optionally a portion of a third edge). The attaching may comprise stitching with thread through both surfaces of the fabric cover as well as both halves of the cushion element. Additionally, the fold may form one edge of the pillow (wherein the method could optionally include stitching the fold as well as the other edges). In an embodiment, the attaching may comprise serging at least a portion of the edges of the two cushion elements and then channel stitching (or single needle stitching) behind the serged portion of the edge. The stitching may effectively seal the edges of the shell formed by the two halves of the cushion element.

In an embodiment, at least a portion of one edge may be left open (not stitched together) so that a step of filling the cavity with filler material may be performed. In some embodiments, an entire edge may be left open, while in other embodiments a small portion of an edge may be left open. In some embodiments, a portion of the edge large enough to accommodate a nozzle and/or hose may be left open. In some embodiments, the filler material may be blown into the cavity of the pillow, for example though a nozzle and/or hose. Once a desired amount of filler material has been placed within the cavity, the method may comprise attaching the remainder of the edge(s) of the cushion element in a similar fashion to the first step of attaching. In some embodiments, the pillow may then be considered completed, or, in other embodiments, the method may continue with further steps of covering the pillow or otherwise preparing the pillow for use by a consumer, for example.

In an embodiment, the attachment of the fabric cover and cushion element (prior to assembly of the pillow) may comprise laminating the fabric cover to the cushion element, wherein a lamination process may comprise the steps of: rolling an adhesive onto at least one surface of the cushion element; placing (for example by rolling) the fabric cover onto the at least one surface of the cushion element with the adhesive there between; rolling the combined fabric cover, adhesive, and cushion element through pressure rollers; and heating the combined fabric cover, adhesive, and cushion elements. In an embodiment, the adhesive may comprise a glue with a water carrier wherein the heating of the combined fabric cover, adhesive, and cushion elements comprises evaporating the water carrier.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A washable pillow comprising:

one or more open cell foam cushion element;

a filler material; and a fabric cover attached to at least one surface of the one or more open cell foam cushion element;

wherein the one or more open cell foam cushion element forms a shell defining an inner cavity;

wherein the filler material is contained within the inner cavity of the shell;

wherein the fabric cover is attached to the one or more cushion element by stitching and at least one of: gluing and laminating; and wherein the stitching attaching the fabric cover to the one or more cushion elements passes through both the fabric cover and the one or more cushion elements and forms a plurality of compartments.

2. The pillow of claim 1 wherein glue is applied to the at least one surface of the one or more open cell foam cushion elements by rolling to substantially cover the at least one surface of the one or more open cell foam cushion elements.

3. The pillow of claim 1 wherein the one or more cushion element comprises two cushion elements attached in proximity to their edges to form the shell and to define the cavity.

4. The pillow of claim 3 wherein the fabric cover is permanently attached to an outer surface of the shell formed by the two cushion elements, and the fabric cover comprises an upper surface layer and a lower surface layer.

5. The pillow of claim 4 wherein the two cushion elements are attached in proximity to their edges by stitching, wherein the stitching comprises threading through the upper surface layer of the fabric cover, the two cushion elements, and the lower surface layer of the fabric cover.

6. The pillow of claim 5 wherein the stitching comprises serging the edges of the cushion elements and the fabric cover, and channel stitching inset in proximity to the serged edges of the fabric cover and the cushion element.

7. The pillow of claim 1 wherein the one or more cushion element comprises one cushion element folded to form two halves, wherein the two halves are attached in proximity to their edges to form the shell and to define the cavity.

8. The pillow of claim 7 wherein the fabric cover is attached to an outer surface of the shell formed by the one cushion element, and the fabric cover comprises an upper surface layer and a lower surface layer.

9. The pillow of claim 8 wherein the two halves of the cushion element are attached in proximity to their edges by stitching, wherein the stitching comprises threading through the upper surface layer of the fabric cover, the two halves of the cushion element and the lower surface layer of the fabric cover.

10. The pillow of claim 1 wherein glue is applied to the outer surface of the shell to substantially cover the outer surface of the shell.

11. A process for assembling a washable pillow comprising:

providing at least one cushion element of open cell foam;

providing at least one fabric cover;

permanently attaching the fabric cover to the cushion element;

forming a shell defining a cavity therein from the at least one cushion element with permanently attached fabric cover;

filling the cavity with a filler material; and sealing the shell to contain the filler material wherein attaching the fabric cover to the cushion element comprises:

applying glue onto substantially the entirety of at least one surface of the cushion element; and placing the fabric cover against the at least one surface of the cushion element with the glue therebetween.

12. The process of claim 11 wherein attaching the fabric cover to the cushion element further comprises stitching to join the fabric cover to the cushion element, wherein the stitching comprises threading through the fabric cover and the cushion element.

13. A process for assembling a washable pillow comprising:

providing at least one cushion element of open cell foam;

providing at least one fabric cover;

permanently attaching the fabric cover to the cushion element;

forming a shell defining a cavity therein from the at least one cushion element with permanently attached fabric cover;

filling the cavity with a filler material; and sealing the shell to contain the filler material;

wherein attaching the fabric cover to the cushion element comprises:

rolling glue onto at least one surface of the cushion element;

placing the fabric cover against the at least one surface of the cushion element with the glue there between; and laminating the fabric cover to the cushion element by heating in a heat tunnel.

14. The process of claim 13 wherein sealing the shell to contain the filler material comprises stitching with thread applied through the fabric cover and the cushion element.

15. The process of claim 14 wherein stitching with thread comprises:

serging the edges of the attached fabric cover and cushion element; and channel stitching at a location inset in proximity to the serged edges of the attached fabric cover and cushion element.

16. The process of claim 13 wherein forming a shell defining a cavity therein from the at least one cushion element with permanently attached fabric cover comprises:

placing two open cell cushion elements adjacent to one another to form the shell with fabric cover on an outer surface of the shell; and attaching at least a portion of the two cushion elements in proximity to their edges.

17. The process of claim 13 wherein forming a shell defining a cavity therein from the at least one cushion element with permanently attached fabric cover comprises:

folding the attached cushion element and fabric cover to form two halves;

placing the two halves adjacent to one another to form the shell with fabric cover on an outer surface of the shell; and attaching at least a portion of the two halves in proximity to their edges.

18. The process of claim 13 wherein attaching the fabric cover to the cushion element further comprises stitching to join the fabric cover to the cushion element, wherein the stitching comprises threading through the fabric cover and the cushion element.

* * * * *